US009824559B2

(12) United States Patent
Patterson et al.

(10) Patent No.: US 9,824,559 B2
(45) Date of Patent: Nov. 21, 2017

(54) SECURITY SENSING METHOD AND APPARATUS

(71) Applicants: Hubert A. Patterson, Boca Raton, FL (US); Melwyn F. Sequeira, Plantation, FL (US)

(72) Inventors: Hubert A. Patterson, Boca Raton, FL (US); Melwyn F. Sequeira, Plantation, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 15/139,555

(22) Filed: Apr. 27, 2016

(65) Prior Publication Data

US 2017/0294088 A1 Oct. 12, 2017

Related U.S. Application Data

(60) Provisional application No. 62/319,410, filed on Apr. 7, 2016.

(51) Int. Cl.

| | |
|---|---|
| ***G08B 13/184*** | (2006.01) |
| ***G08B 13/196*** | (2006.01) |
| ***G08B 25/10*** | (2006.01) |
| ***G08B 13/187*** | (2006.01) |

(52) U.S. Cl.

CPC ..... *G08B 13/184* (2013.01); *G08B 13/187* (2013.01); *G08B 13/19626* (2013.01); *G08B 25/10* (2013.01)

(58) Field of Classification Search

CPC ..... G08B 13/184

(Continued)

(56) References Cited

U.S. PATENT DOCUMENTS

| | | | |
|---|---|---|---|
| 4,325,146 | A | 4/1982 | Lennington |
| 4,993,068 | A | 2/1991 | Piosenka et al. |

(Continued)

FOREIGN PATENT DOCUMENTS

| | | | |
|---|---|---|---|
| CN | 203825788 | U | 9/2014 |
| EP | 2495621 | A1 | 9/2012 |

(Continued)

OTHER PUBLICATIONS

Rais, N.H.M., et al., "A Review of Wearable Antenna," Antennas & Propagation Conference, 2009, LAPC 2009, Loughborough, Published IEEE; 978-1-4244-2720-8; DOI: 10.1109/LAPC.2009.5352373.

(Continued)

*Primary Examiner* — Kevin Kim

(74) *Attorney, Agent, or Firm* — Fox Rothschild LLP; Robert J. Sacco; Carol E. Thorstad-Forsyth

(57) ABSTRACT

Optical data transceiver is used to illuminate a secured space with an optical data signal which has been modulated to contain a first data sequence. One or more retroreflected optical data signals are received at the optical data transceiver from reflector elements disposed in the secured space. The retroreflected optical data signals are authenticated and a security event notification is selectively communicated to an enterprise security management controller if a variation occurs in regard to at least one retroreflected optical beam condition. The variation can involve a disruption of the optical beam and/or a displacement of the optical beam.

21 Claims, 7 Drawing Sheets

(58) Field of Classification Search
USPC ..... 340/545.3, 555, 556, 557
See application file for complete search history.

(56) References Cited

U.S. PATENT DOCUMENTS 5,365,266 A * 11/1994 Carpenter ..... G06F 3/0304 348/61
5,387,993 A 2/1995 Heller et al.
5,502,447 A 3/1996 Kumpfbeck et al.
5,532,705 A 7/1996 Hama
5,763,868 A 6/1998 Kubota et al.
5,947,369 A 9/1999 Frommer et al.
5,960,085 A 9/1999 de la Huerga
5,966,227 A 10/1999 Dubois et al.
5,988,645 A * 11/1999 Downing ..... F41J 5/02 250/222.2
6,219,439 B1 4/2001 Burger
6,288,644 B1 * 9/2001 Mathews ..... G08B 13/18 250/559.45
6,339,999 B1 * 1/2002 Newell ..... A61D 17/002 119/174
6,346,886 B1 2/2002 De La Huerga
6,788,262 B1 9/2004 Adams et al.
6,888,502 B2 5/2005 Beigel et al.
6,950,098 B2 9/2005 Brabander et al.
7,119,688 B2 10/2006 Wildman
7,202,789 B1 4/2007 Stilp
7,424,316 B1 9/2008 Boyle
7,450,024 B2 11/2008 Wildman et al.
7,450,077 B2 11/2008 Waterhouse et al.
7,629,934 B2 12/2009 Rhodes et al.
7,696,882 B1 4/2010 Rahimi et al.
7,849,619 B2 12/2010 Mosher, Jr. et al.
7,898,385 B2 3/2011 Kocher
7,982,616 B2 7/2011 Banerjee et al.
7,983,565 B2 7/2011 Varshneya et al.
8,267,325 B2 9/2012 Phaneuf
8,447,188 B2 5/2013 Scott et al.
8,497,808 B2 7/2013 Wang
8,502,681 B2 8/2013 Bolling et al.
8,599,101 B2 12/2013 Christie et al.
8,646,695 B2 2/2014 Worrall et al.
8,674,810 B2 3/2014 Uysal et al.
8,917,214 B2 12/2014 Forster
8,985,439 B2 3/2015 Braun
9,076,273 B2 7/2015 Smith et al.
9,384,608 B2 7/2016 Strulovitch et al.
9,514,584 B1 12/2016 Burge et al.
9,519,853 B2 12/2016 Tolle
9,600,999 B2 * 3/2017 Stenzler ..... G08B 21/22
2002/0084904 A1 7/2002 De La Huerga
2002/0140558 A1 10/2002 Lian et al.
2003/0005193 A1 1/2003 Seroussi et al.
2004/0085208 A1 5/2004 Fukuoka
2004/0246103 A1 12/2004 Lukowski
2005/0168340 A1 8/2005 Mosher et al.
2005/0285740 A1 12/2005 Kubach et al.
2006/0022816 A1 * 2/2006 Yukawa ..... G08B 25/006 340/521
2006/0219778 A1 10/2006 Komatsu
2007/0182559 A1 8/2007 Lawrence et al.
2008/0055045 A1 3/2008 Swan et al.
2008/0074652 A1 * 3/2008 Fouquet ..... G01C 21/02 356/218
2009/0121931 A1 5/2009 Katz
2009/0322513 A1 12/2009 Hwang et al.
2010/0315244 A1 12/2010 Tokhtuev et al.
2010/0328043 A1 12/2010 Jantunen et al.
2011/0022121 A1 1/2011 Meskins
2011/0148602 A1 6/2011 Goh et al.
2011/0206378 A1 8/2011 Bolling et al.
2011/0316700 A1 12/2011 Kasahara et al.
2012/0056719 A1 3/2012 Krishna et al.
2012/0189312 A1 7/2012 Maryfield et al.
2012/0234921 A1 9/2012 Tiedmann et al.
2012/0242481 A1 9/2012 Gemandt et al.
2012/0242501 A1 9/2012 Tran et al.
2012/0256492 A1 10/2012 Song et al.
2012/0286927 A1 11/2012 Hagl
2013/0010962 A1 1/2013 Buer et al.
2013/0027180 A1 1/2013 Lakamraju et al.
2013/0221938 A1 8/2013 Conte et al.
2014/0068742 A1 3/2014 Phillips
2014/0077929 A1 3/2014 Dumas et al.
2014/0159959 A1 6/2014 Rhoads et al.
2014/0159975 A1 6/2014 Apostolos et al.
2014/0226844 A1 8/2014 Kerselaers
2014/0240087 A1 8/2014 Liu et al.
2014/0240088 A1 8/2014 Robinette et al.
2014/0327517 A1 11/2014 Portet
2014/0354494 A1 12/2014 Katz
2014/0375429 A1 12/2014 Cristache
2015/0022321 A1 1/2015 Lefevre
2015/0041614 A1 2/2015 Tran et al.
2015/0054696 A1 2/2015 Werner et al.
2015/0070134 A1 3/2015 Nagisetty et al.
2015/0078741 A1 3/2015 O'Connor et al.
2015/0149310 A1 5/2015 He et al.
2015/0154486 A1 6/2015 McFarthing et al.
2015/0168554 A1 6/2015 Aharoni et al.
2015/0180716 A1 6/2015 Aminzade
2015/0185160 A1 * 7/2015 Lacoste ..... B42D 25/29 356/398
2015/0188632 A1 7/2015 Aoyama et al.
2015/0221147 A1 8/2015 Daniel-Wayman et al.
2015/0250419 A1 9/2015 Cooper et al.
2015/0264431 A1 9/2015 Cheng
2015/0280829 A1 10/2015 Breuer et al.
2015/0339870 A1 11/2015 Cojocaru et al.
2015/0341114 A1 11/2015 Pederson
2015/0365166 A1 12/2015 Deyle et al.
2015/0379791 A1 12/2015 Russell et al.
2016/0007315 A1 1/2016 Lundgreen et al.
2016/0014103 A1 1/2016 Masters et al.
2016/0055692 A1 2/2016 Trani
2016/0095189 A1 3/2016 Vangeel et al.
2016/0164607 A1 6/2016 Pederson
2016/0267760 A1 9/2016 Trani
2016/0284183 A1 9/2016 Trani
2016/0294835 A1 10/2016 Beaumont et al.
2016/0343187 A1 11/2016 Trani
2016/0344091 A1 11/2016 Trani
2017/0026118 A1 1/2017 Pederson
2017/0228953 A1 8/2017 Lupovici

FOREIGN PATENT DOCUMENTS

WO WO 83/01855 * 5/1983 ..... G08B 13/00
WO 1999041721 A1 8/1999
WO 2014/113882 A1 7/2014
WO 2014210000 A1 12/2014
WO 2015/023737 A1 2/2015

OTHER PUBLICATIONS

Hall, P.S., et al., "Antennas and Propoagation for Body Centric Communications," Proc. 'EUCAP 2006', Nice, France, Nov. 6-10, 2006 (ESA SP-626, Oct. 2006).
Conway, G.A., et al., "Antennas for Over-Body-Surface Communication at 2.45 GHz," IEEE Transactions on Antennas and Propagation, vol. 57, No. 4, Apr. 2009, 0018-926X, copyright 2009 IEEE.
Ito, K., et al., "Wearable Antennas for Body-Centric Wireless Communications," copyright IEEE 2010; 978-1-4244-6418-0/10.
Matthews, J.C.G., et al., "Body Wearable Antennas fo UHF/VHF," 2008 Loughborough Antennas & Propagation conference, 978-1-4244-1894-7108, copyright 2008 IEEE.

* cited by examiner

SECURITY SENSING METHOD AND APPARATUS

CROSS-REFERENCE TO RELATED APPLICATIONS

This application claims the benefit of provisional U.S. Patent Application No. 62/319,410, filed on Apr. 7, 2016, which is hereby incorporated herein by reference.

BACKGROUND OF THE INVENTION

Statement of the Technical Field

The inventive arrangements relate to security systems and more particularly to security systems which employ sensors for detecting the opening and closing of doors and windows.

Description of the Related Art

Security systems for homes and commercial establishments commonly employ sensors for detecting the opening and closing of doors and windows. Various types of sensors have been developed for this purpose. For example, some sensors are battery powered and wirelessly coupled to control circuitry associated with a security system or enterprise monitoring system. But the batteries used in such wireless sensors need to be periodically replaced to ensure a properly functioning sensor, thus putting a strain on serviceability. Other types of window and door sensors are passive devices. These devices are conventionally connected to the circuitry of the security system and/or the enterprise monitoring stations by means of a wired connection. But it is commonly accepted that wired connections are undesirable in many security applications because the wires provide a point of weakness to the security system. A further drawback of such conventional wired arrangements is that they tend to increase the cost and complexity of installing the security system.

Some conventional sensors for detecting the opening and/or closing of windows and/or doors use Hall Effect sensing mechanisms. Other types of conventional sensors used for this purpose include an optically coupled transmitter and receiver to detect the opening and closing of doors and windows. In such conventional systems, when the magnetic or optical coupling is "broken" between the transmitting and receiving magnetic device, the system sends a message to the security system control system or enterprise monitoring station using either a wired or wireless communications mechanism, indicating the intrusion. Such conventional wired or wireless battery powered sensors are susceptible to electrical noise due to environmental disturbances. Exemplary disturbances can include RF interference experienced by the wireless connection, mechanical vibration of the sensor, lighting strikes, and so on.

An improvement over the above described intrusion sensing mechanism, requiring no batteries and or wiring, is the self-powered door/window opening sensor described in the Applicant's U.S. Provisional Application No. 62/160,641, however, this mechanism still requires RF wireless communications infrastructure and a piezo electric device mounted to each door being monitored to generate the power on demand required, to drive the wireless radio communications device.

SUMMARY OF THE INVENTION

Embodiments of the invention concern a method and system for performing security sensing. The method involves using an optical data transceiver to illuminating a secured space with an optical data signal which has been modulated to contain a first data sequence. Thereafter, one or more retroreflected optical data signals are received at the optical data transceiver. The retroreflected optical data signals are signals which have been respectively retroreflected from reflector elements disposed in the secured space in response to the optical data signal. The process further involves authenticating one or more of the retroreflected optical data signals by determining whether the first data sequence is present therein. A security event notification is selectively generated and communicated to an enterprise security management controller if a variation occurs in regard to at least one optical beam condition associated with one or more of the plurality of optical data signals. The variation can involve one or more of a disruption of the optical beam and a displacement of the optical beam.

According to one aspect, the optical data transceiver can be used to facilitate wireless network access to a computer data network. The computer data network in such scenarios can be used to communicate the security event notification to the enterprise security management controller. Also, the first data sequence used for security sensing can comprise at least a portion of a management frame defined for a predetermined wireless communication protocol implemented by the optical data transceiver as part of the wireless network access function.

An embodiment also concerns an optical security sensing apparatus involving a plurality of retroreflectors disposed in a secured area and an optical transceiver. The optical transceiver can include an optical transmitter unit and an optical receiver unit. The optical transmitter unit is configured to illuminate at least a portion of the secured space with an optical data signal which has been modulated to contain a first data sequence. The optical receiver unit is configured to concurrently receive one or more retroreflected optical data signals which have been respectively retroreflected from the plurality of reflector elements in response to the optical data signal.

At least one processing element is provided which is configured to receive a plurality of digital data streams extracted respectively from the retroreflected optical data signals. For example, the at least one processing element can be provided as part of the optical transceiver. The at least one processing element can be arranged to determine whether the first data sequence is present in one or more of the plurality of retro-reflected optical data signals. The at least one processing element can also be configured to detect a variation in regard to at least one optical beam condition associated with one or more of the retroreflected optical data signals. Such variation can comprise a disruption of the optical beam and/or a displacement of the optical beam. The processing element can selectively generate a security event notification message if the variation is detected. The optical transceiver described herein can further be configured to function as a wireless network access point. In such scenario, the optical data signal can comprise at least a portion of a management frame defined for a predetermined wireless communication protocol.

BRIEF DESCRIPTION OF THE DRAWINGS

Embodiments will be described with reference to the following drawing figures, in which like numerals represent like items throughout the figures, and in which.

DETAILED DESCRIPTION

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

An improved door/window opening sensing method and apparatus is disclosed herein which makes use of an optical transceiver which can include one or more processing elements, and one or more passive remote sensor elements. According to one aspect, conventional active sensing devices are replaced with one or more totally passive devices which are placed on doors or windows. These passive devices are responsive to an optical signal from the optical transceiver to communicate door status information. This door status information is received by the optical transceiver using an optical detector element, which can be a video camera, to detect opening and/or closing of windows and doors in a secured facility.

Figure 1:
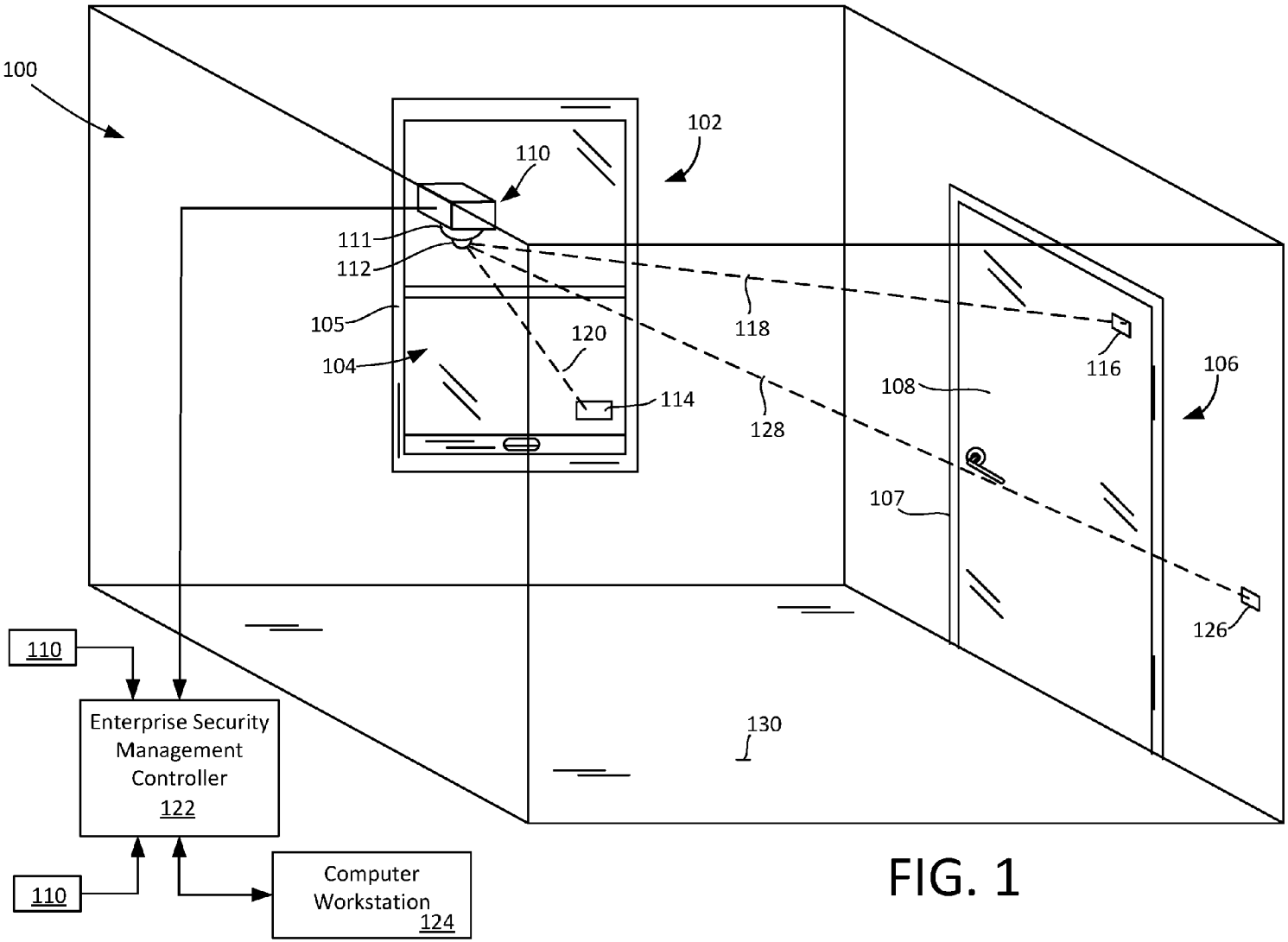
FIG. 1 is a conceptual drawing of a security sensing apparatus that is useful for understanding an embodiment.
Figure 2:
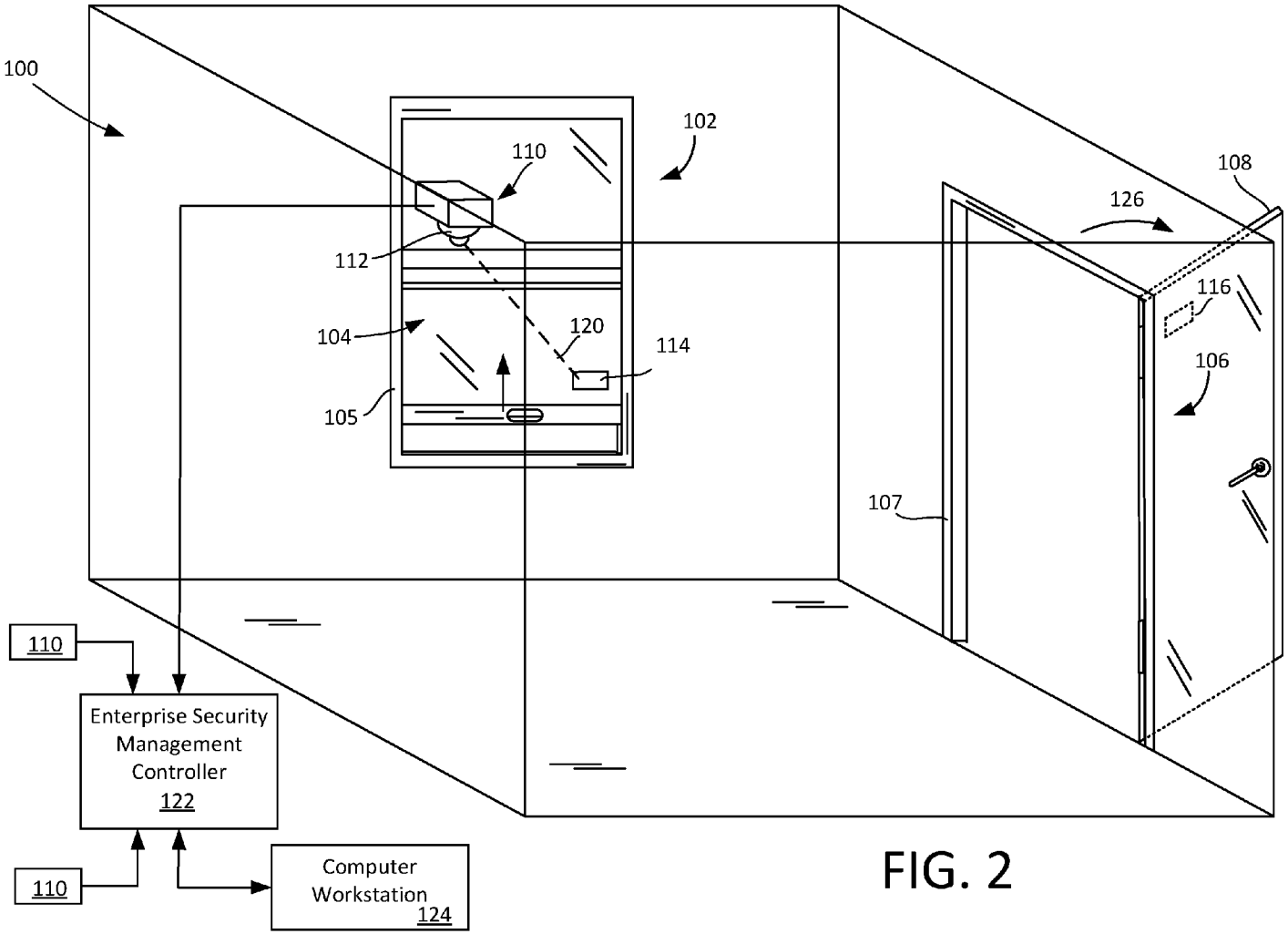
FIG. 2 is a conceptual drawing of the security sensing apparatus in FIG. 1 wherein a window and door have been opened.

Referring now to FIGS. 1 and 2, a secured facility 100 can comprise a structure such as an office building, warehouse, or dwelling. As is known, such a construction can have one or more defined opening such as a window opening 102 and a doorway 106. The window opening 102 can be defined by a window frame 105 which supports one or more movable window panels. For example, in FIG. 1, a window panel 104 can slide along a track defined in the window frame 105 to move from a first position shown in FIG. 1 to a second position as shown in FIG. 2. Similarly, the doorway 106 can be defined by a door frame 107 which supports a door, such as door 108. The door 108 can be attached to the doorway by suitable means to facilitate movement of the door to allow ingress and egress by one or more persons into the secured facility. According to one aspect, the door 108 can be connected to the door frame 107 by means of one or more hinge members to facilitate a door opening and closing operation. For example, as shown in FIG. 2 a door 108 can be arranged to open in a direction indicated by arrow 126.

The secured facility 100 is advantageously protected against unauthorized entry by an enterprise security system which includes an optical sensing system. The optical sensing system is comprised of an optical transceiver 110 and one or more reflector elements 114, 116, 126. According to one aspect, one or more of the reflector elements 114, 116, 126 are retroreflectors as discussed below in further detail. A retroreflector is a device or surface that reflects light back to its source with a minimum of scattering. An optical transceiver 110 as described herein comprises an optical source 111 (such as a light emitting diode) and an optical receiver 112 (such as a photodetector or a video camera). In an embodiment the optical transceiver 110 can also include one or more processing elements to perform certain processing functions as hereinafter described. An embodiment optical transceiver is discussed below in further detail in relation to FIG. 6. In some embodiments, the optical transceiver 110 can be integrated into a lighting system for the facility contained in the ceiling, such that the same optical radiation used for illuminating a room can also be used for the security functions described herein.

Figure 3:
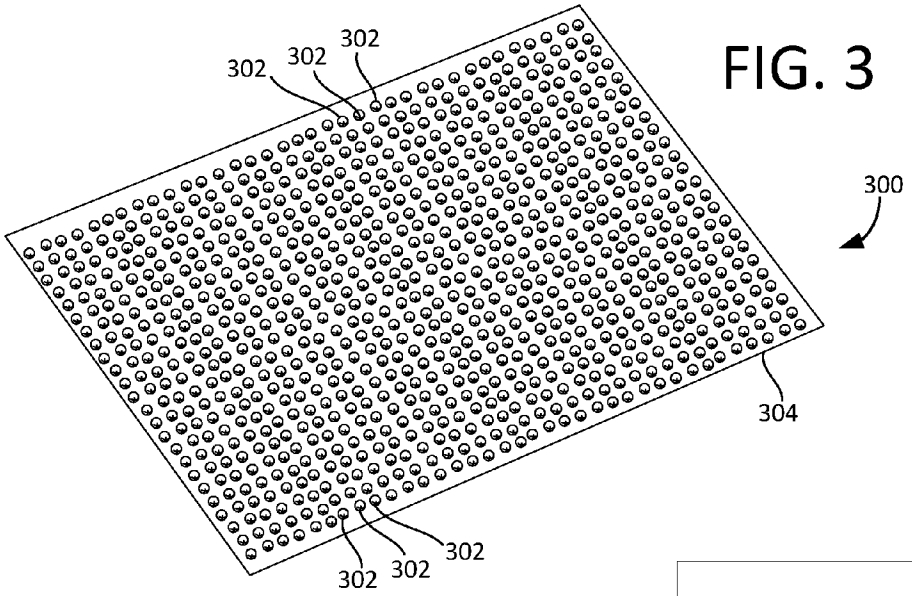
FIG. 3 is a drawing of a retroreflector element which is useful for understanding an embodiment.

Referring now to FIG. 3, there is shown an exemplary reflector element 300 which is useful for understanding the invention. In an embodiment, the reflector element 300 is a retroreflector, meaning that it reflects light back to its source with a minimum of scattering. Retroreflectors can be implemented in various ways and so the exact construction of the retroreflector is not critical for purposes of the present invention. However, in an exemplary reflector element 300 can be comprised of a plurality of transparent optical beads or microspheres 302. Accordingly, an optical wave which arrives at the reflector element 300 in a first vector direction is reflected back along a second vector direction that is parallel to but opposite to the transmit vector direction. The microspheres can be secured or embedded in a binder material 304 in a random or predetermined pattern. The binder material 304 can be a colorless clear paint, a flexible substrate in the form of a tape with adhesive disposed on one surface to secure the tape to a surface, or any other suitable material that is capable of securing the microspheres in a location.

Figure 4:
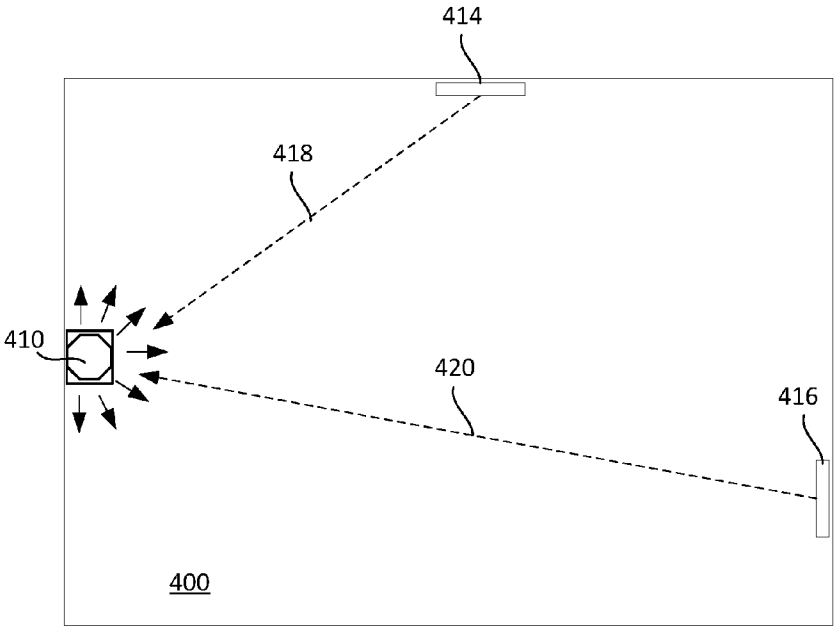
FIG. 4 is a schematic representation of a security sensing apparatus which is useful for understanding the function and operation of the retroreflector element in FIG. 3.

An embodiment is illustrated in FIG. 4 which shows that an optical source 410 and reflector elements 414, 416 which are retroreflectors disposed in a three-dimensional space. The optical source 410 has an omnidirectional optical source pattern and can illuminate the three-dimensional space 400. The omnidirectional optical source pattern is indicated by a plurality of vector arrows in FIG. 4 which show that optical radiation from the optical source 410 is transmitted in all directions from the source. As shown in FIG. 4, the transmitted optical radiation which is incident upon the reflector elements 414, 416 is reflected back to the source in a vector direction 418, 420 which is parallel but opposite to the vector direction of the incident optical radiation. So when the optical source 410 illuminates one of the reflector elements 414, 416, the reflected light will be directed towards the optical source and any associated optical receiver rather than in all directions as would occur with diffuse reflection.

An advantage of the retroreflectors described herein is that these are passive devices and hence require no power to engage in communications with the optical transceiver 110. The modulated optical signal transmitted from the optical transceiver is reflected right back from these retroreflectors to the optical source, thus making these passive receivers virtually a permanent part of the structure.

Referring once again to FIGS. 1 and 2, a modulated optical signal is transmitted from the optical source 111 to illuminate at least a portion of the secured facility 100. The optical source and optical receiver can be substantially co-located as shown in FIGS. 1 and 2. Consequently, the modulated optical beam from the source can be retro-reflected by one or more of the reflector elements 114, 116, 126 back to the optical receiver 112. The optical receiver 112 detects the reflected modulated optical signal 118, 120, 128 and performs certain processing operations on the received signal. According to one aspect, one or more processing elements provided in the optical transceiver 110 are used to demodulate or process the received optical signal to extract data or information embedded in the modulated signal. The extracted data is then compared with the modulated data contained in the signal that was transmitted by the optical source 111 to verify that the received optical signal is in fact a reflection of the transmitted signal. This verification step helps to prevent the optical transceiver 110 from generating false alarms caused by ambient light from other sources and/or intentional efforts to spoof the security system.

According to one aspect of the invention, a reflected optical signal from one or more of the reflector elements 114, 116, 126 is monitored by a processing element (e.g. a processing element associated with the optical transceiver 110). Disturbances associated with the reflected optical signal are then used to monitor openings and closing of the doors and windows and/or other intrusions for purposes of triggering alerts and/or alarms.

In the simplest case, a disturbance associated with a reflected optical signal can comprise an interruption or disruption of the reflected signal such that the presence of the reflected signal is no longer detected at the optical transceiver 110. As an example, such an interruption in the reflected optical signal could occur when a door 108 moves from a closed position as shown in FIG. 1 to an open position as shown in FIG. 2. When this occurs, the reflector element 116 is rotated with the door 108 to an orientation in which it is no longer able to effectively reflect a transmitted optical signal to the optical receiver 112. For example, the reflector element 116 may no longer be positioned within a line of sight of the optical transceiver. Consequently, the optical transceiver 110 will detect that disruption in the reflected optical signal and use this occurrence to trigger an event notification to an enterprise security management controller 122. The disruption can involve the optical signal no longer being detected, but can also involve a substantial change in the optical signal strength or intensity of the optical signal being received. In a scenario where the optical transceiver 110 is monitoring only a single reflected optical signal (e.g., from a single reflector element 116), a simple solid state photo detector provided in the optical transceiver can be used to receive the reflected optical signal. An associated processing element monitoring the output of the solid state photodetector can then detect the interruption or disruption of an optical signal as described herein.

A similar approach can be used to detect the presence of motion or persons within the secured facility 110. For example, a reflector element 126 as described herein can be disposed on a fixed interior portion of a structure associated with the secured facility 100. The reflector element 126 in FIGS. 1 and 2 is shown disposed on a wall, but the invention is not limited in this regard. In some scenarios, it may be desirable to dispose one or more such reflector elements on a floor 130 of the secured facility. A person walking past the reflector element (e.g. reflector element 126) will interrupt the optical illumination of reflector element 126 by the optical source 111, and interrupt or block the transmission of the reflected modulated optical signal 128 to the optical receiver 112. The disruption of the reflected modulated optical signal 128 will be detected by the optical transceiver 110 and it can use this occurrence to trigger an event notification to an enterprise security management controller 122.

A solid state optical detector element can be sufficient for monitoring a reflected optical signal from a single reflector element. But for purposes of monitoring a plurality of reflector elements 114, 116, 126 the optical receiver 112 associated with the optical transceiver is advantageously a video camera. Use of a video camera as the optical receiver 112 can facilitate concurrent monitoring of reflected optical signals from a plurality of reflector elements by a single optical transceiver 110.

Figure 5A:
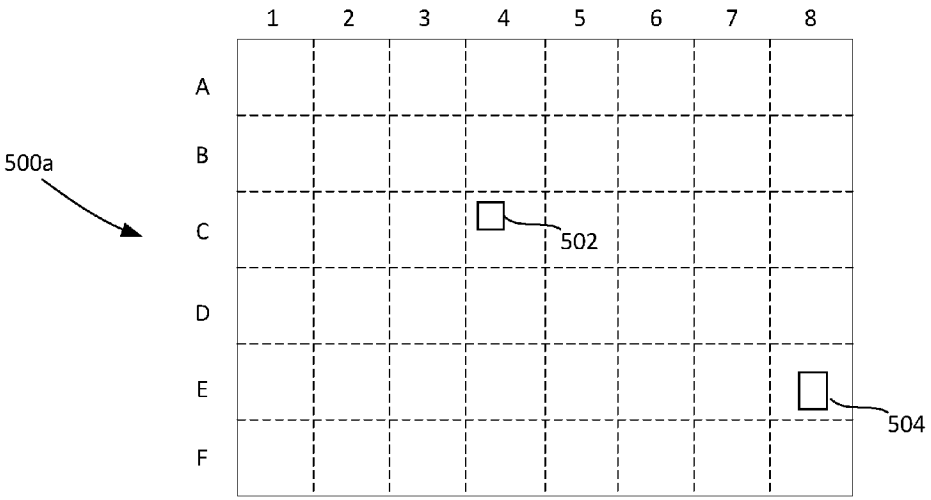
FIGS. 5A and 5B are drawings respectively showing a first and second video frame in which a captured image includes an optical response of a retroreflector element.
Figure 5B:
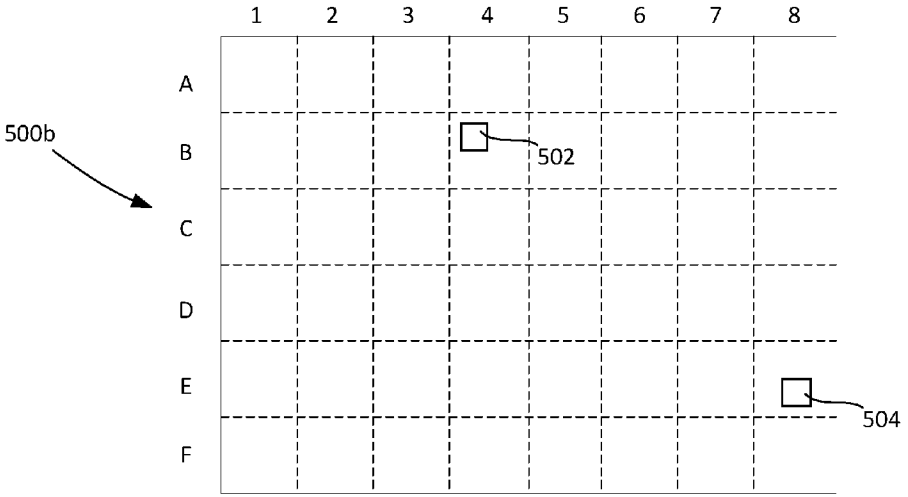

An optical receiver (such as optical transceiver 112) which comprises a video camera can capture one or more video frame images. In an arrangement as described with respect to FIGS. 1 and 2, the video camera can capture video frame images which include reflected optical signals (e.g., reflected modulated optical signals 118, 120, 128). This concept is illustrated in FIGS. 5A and 5B which respectively show a first video frame image 500*a* captured at a first moment in time, and a second video frame image 500*b* captured at a later moment in time. As an aid to understanding the invention, grid lines in the first and second video frame images are used to delineate a plurality of rows A through F and a plurality of columns 1 through 8.

In the first video frame image 500*a*, modulated optical signals 502 and 504 are detected within the frame. More particularly, reflected modulated optical signal 502 from a first reflector element (not shown) activates pixels in a frame portion C-4 (i.e., where row C and column 4 intersect). Similarly, modulated optical signal 504 from a second reflector element (not shown) activates pixels in frame portion E-8. An electronic processing element associated with optical transceiver 110 can identify or isolate the activated pixels which are associated with each reflected modulated optical signal, and process the optical signal received by those pixels to independently extract modulated data from each signal 502, 504. Accordingly, the optical transceiver 110 can concurrently independently monitor a position and/or intensity of a plurality of reflected modulated optical signals. Data can be extracted from each signal to verify that it is a reflection of a transmitted signal originating from the optical transceiver 110.

In the second video frame image 500*b* captured at a later moment in time, it can be seen that reflected modulated optical signal 504 is still present in frame portion E-8. But reflected modulated optical signal 502 has moved position within the frame from C-4 to B-4. The change in relative position of the modulated optical signal 502 in frame 500*b* as compared to 500*a* is an indication that a reflector element associated with such modulated optical signal 502 has moved. For example, such reflector movement might occur when a window panel 104 (to which reflector 114 is applied) is moved from a first position shown in FIG. 1 to a second position shown in FIG. 2. A processing element associated with optical transceiver 110 can detect this change in position and use this occurrence to trigger an event notification to an enterprise security management controller 122.

The processing element can detect disruptions in the intensity of an optical signal associated with each reflected modulated optical signal captured by the video camera. Similarly, if reflected modulated optical signals 502, 504 are detected in first frame 500*a*, but only signal 504 was detected in a second frame, the absence of signal 502 can be attributed to some action which interrupted optical signal 502. For example, such interruption might be caused by a door 108 opening, as shown in FIG. 2, which disrupts a reflected signal from reflector element 116. Alternatively, in the case of a reflector 126 attached to an immovable surface, the interruption in the reflected signal could be attributed to a person passing in front of a reflected optical beam. A processing element associated with optical transceiver 110 can detect one or more such occurrences and use them to selectively trigger an event notification to an enterprise security management controller 122.

Changes or disruptions in the optical signals captured in a video frame can be detected by comparing an image frame to an earlier capture image stored in a database. The image comparison functions described herein can be performed by a processing element associated with the optical transceiver or in an enterprise security management controller. If the optical receiver is a video camera, the detection of a disturbance or variation in the reflected modulated optical signal can also be used to trigger one or more video image frames to be stored in a memory location in the optical transceiver 110. The captured video frame image can then be communicated to the enterprise security management controller together with the event notification. Accordingly, a video record or the activities associated with the event notification can be retrieved for later inspection.

When an event notification is generated, the notification can include data specifying the location of the optical transceiver 110. The event notification can also specify a particular door, window or location in the secured facility where a disturbance has been detected with regard to a reflected modulated optical signal. The foregoing step can require a learning or training process in which reflectors associated with particular windows, doors or locations are identified to the optical transceiver 110. Thereafter, any event notification communicated to an enterprise security management controller concerning a particular reflector element can include metadata which specifies the door, window or location where the event was detected.

For example, during a training period a signal 504 could be assigned a metadata tag indicating that it is associated with the door to a particular first office, room or corridor. Reflector element 502 could be assigned a metadata tag indicating it is a window outside, within or adjacent to the first office, room or corridor. Once the tags have been defined in this way, a subsequent disturbance of a reflected modulated optical signal associated with such tag can generate an event notification including metadata to specify the location where a security event was detected.

In an embodiment, an optical transceiver as described herein can comprise a wireless access point of a data network. As such, the optical transceiver can use an optical part of the electromagnetic spectrum to facilitate wireless communications with one or more network devices which may be present in a secured facility, and other components of a data network. For example, the optical transceiver can use the same optical source and optical receiver for wireless access and security sensing operations as described herein. According to one aspect, each optical transceiver can comprise a Li-Fi wireless network access point. As is known, Li-Fi is a bidirectional high speed and fully networked wireless communication technology. Li-Fi is similar to Wi-Fi and uses IEEE 802.15.7 protocols, but offers higher data rates. Li-Fi uses radiation in the optical wavelength range to facilitate such wireless communication. For example, Li-Fi can be implemented using light in the visible, infra-red, and near ultra-violet range.

An embodiment as described above is illustrated in FIG. 6 which shows that a secured facility 600 may include a plurality of optical transceivers 610. Each optical transceiver 610 is arranged to monitor a portion of the secured facility using reflector elements in a manner similar to that described herein with respect to FIGS. 1-5. Each optical transceiver 610 is also wireless access point of a data network 600 which utilize an optical part of the electromagnetic spectrum to wirelessly communicate with one or more client network devices 614 which may be present the a secured facility.

According to one aspect, the same optical signals used for optical wireless data network communications can be used for optical security sensing as described herein. For example, Li-Fi wireless access points will periodically generate certain types of management frames which are used to allow for the maintenance of communications. One such management frame is known as a beacon frame. The beacon frame is used to periodically announce the presence of the wireless access point. It typically contains source and destination media access control (MAC) addresses, its service set identifier (SSID), a timestamp, and other parameters of interest to wireless network devices seeking to communicate through the access point. A common default beacon interval is about once every 100 milliseconds. An optical transceiver which is used for security sensing as described herein can transmit its beacon frame in a conventional manner. The optical transceiver can then compare the information contained in a transmitted beacon frame to data contained in a received optical signal to determine whether the received signal is a reflected modulated signal. If so, the reflected modulated signal derived from the beacon frame can be used for security sensing purposes to detect openings and/or closings of windows and/or doors as disclosed. The reflected beacon frame signal can also be used to detect motion as described herein. Of course, other signals communicated as part of the data network operation can also be used for security sensing without limitation. Further, it should be appreciated that in some scenarios, security dedicated optical signals can be used to facilitate the security functions described herein. Such security dedicated optical signals can be transmitted and received using the same optical source and receiver as used with the data network functions, but would be exclusively used for security sensing purposes. For example, the modulated optical data signal from the optical transceivers could include the location (coordinates) of the optical transceiver source, the occupant of the office and/or those authorized to enter a secured area, and various other attributes specific to the door being monitored.

Figure 6:
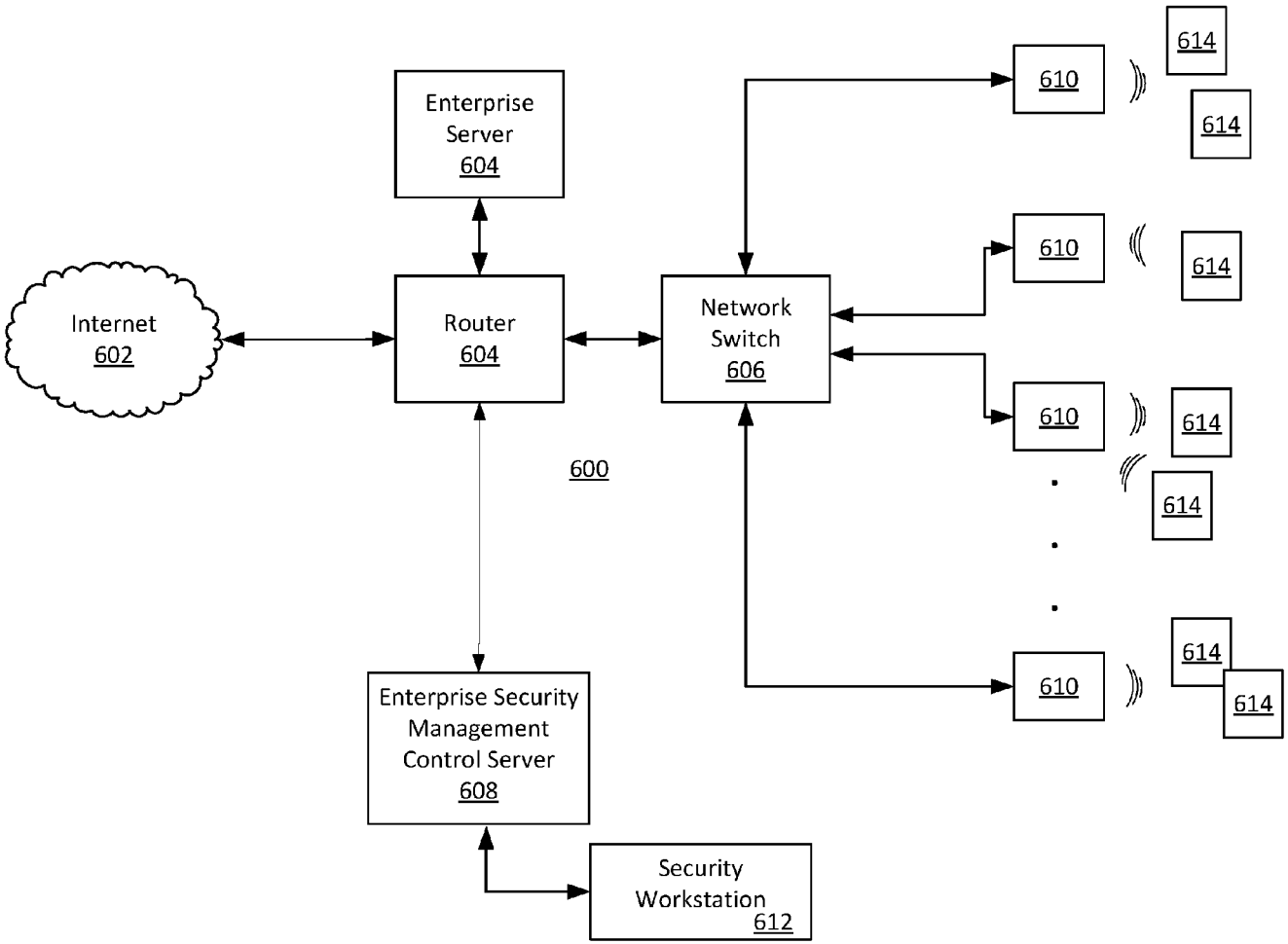
FIG. 6 is a block diagram which is useful for understanding how an optical data transceiver can be used in connection with a computer data network.

As shown in FIG. 6, the computer network 600 can include a network switch 606 for switching data communicated to and from the various optical transceivers 610, a router 604, and one or more enterprise servers 604 to facilitate enterprise level operations. Communication from the optical transceivers 610 to an enterprise security management control server 608 can be facilitated by the router 604. The router can also facilitate network data access to the internet 602 as shown.

Figure 7:
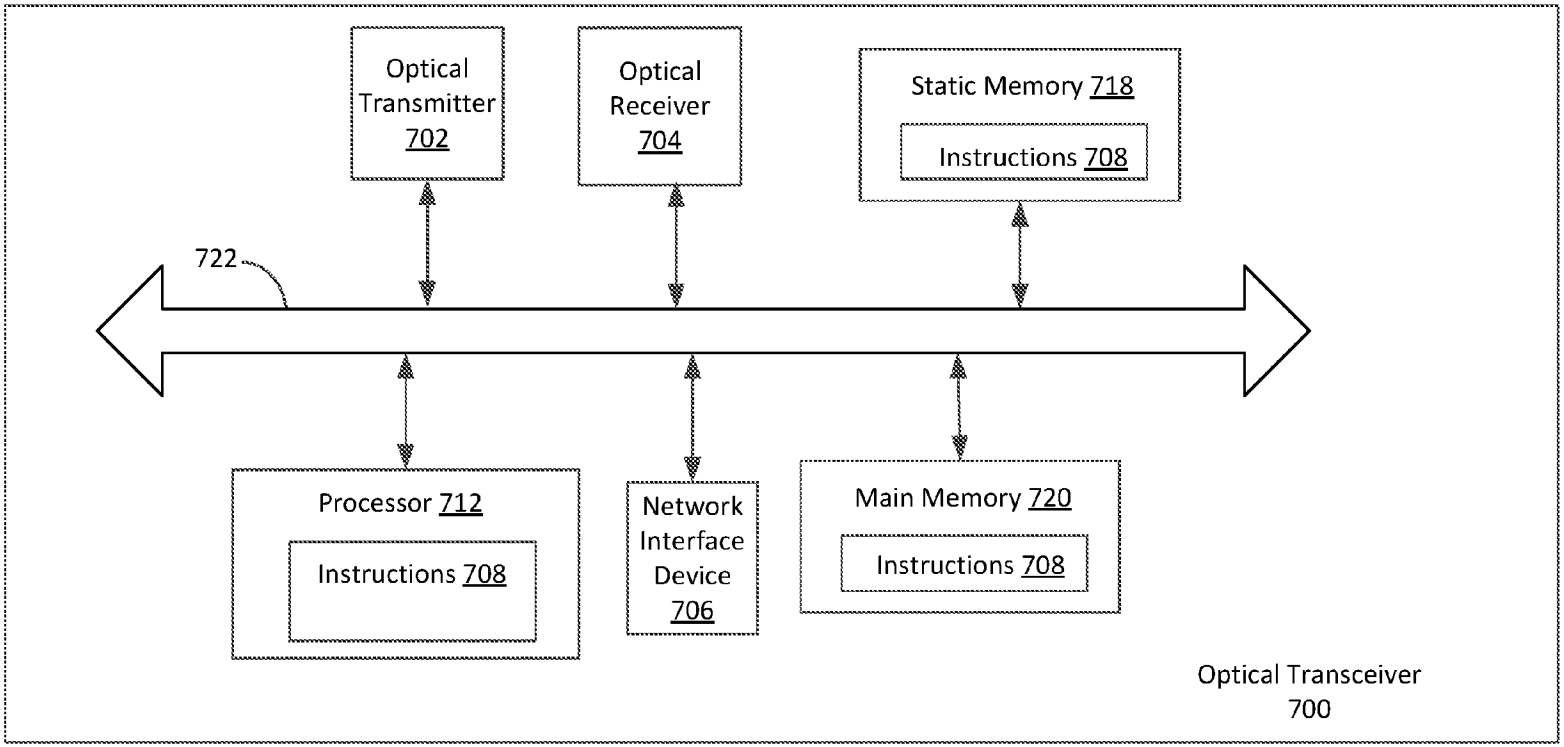
FIG. 7 is a block diagram which is useful for understanding an optical transceiver according to an embodiment.

Referring now to FIG. 7, there is shown a block diagram of an exemplary optical transceiver 700 in accordance with the inventive arrangements. The optical transceiver is configured to perform security sensing functions as described herein. The optical transceiver 700 can also comprise a wireless optical access node for a data network. For example, the optical transceiver can comprise a Li-Fi type wireless optical data access node operating in accordance with a standard IEEE 802.15.7. Accordingly, one or more hardware elements which are used to facilitate Li-Fi type wireless optical data communications can also function to facilitate the security sensing functions described herein. Further, the same optical signals which are communicated by the optical transceiver 700 to facilitate wireless network access functions can also be used for the security sensing functions described herein.

Referring now to FIG. 7, an optical transceiver system 700 includes a processor 712 (such as a central processing unit (CPU), a graphics processing unit (GPU, or both), a main memory 720 and a static memory 718, which communicate with each other via a bus 722. The system 700 can further include an optical transmitter 702 (which can comprise an LED and associated LED driver circuitry), and an optical receiver 704 which can be in the form of a video camera and/or a photo detector depending on the particular implementation. The optical transceiver system 700 can also include a network interface device 706 to facilitate communications with one or more network infrastructure components of a local area network (e.g. network 600) using a computer data network communication protocol. The network interface device 706 can be configured to facilitate a wired or wireless connection to the data network.

The output of the optical transmitter 702 is under control of the processor 712. For example, the processor 712 can control the optical transmitter 702, optical receiver 704 and network interface device 706 to facilitate security sensing operations as described herein. The processor 712 can also perform processing operations in support of such security sensing operations as described herein. In some embodiments, the processor can cause the optical transmitter 702 to output a data modulated optical output signal which is exclusively used for security sensing operations as described herein. In other embodiments, the processor 712 can also facilitate a wireless optical access point function. In such a scenario, the processor can utilize optical transmitter 702, optical receiver 704 and network interface device 706 to provides client devices (e.g. devices 614) with wireless optical access to a data network (e.g. a network 600). In that case, one or more transmitted signals used to facilitate the wireless optical access point functions can also be used by the processor 712 to facilitate optical security sensing as described herein.

In the optical transceiver 700, the main memory 720 is comprised of a computer-readable storage medium (machine readable media) on which is stored one or more sets of instructions 708 (e.g., software code) configured to implement one or more of the methodologies, procedures, or functions described herein. The instructions 708 can also reside, completely or at least partially, within the static memory 718, and/or within the processor 712 during execution thereof by the computer system. Those skilled in the art will appreciate that the optical transceiver system architecture illustrated in FIG. 7 is one possible example of such a system, but is not intended to be limiting in this regard. Any other suitable optical transceiver system architecture can also be used without limitation. Dedicated hardware implementations including, but not limited to, application-specific integrated circuits, programmable logic arrays, and other hardware devices can likewise be constructed to implement the methods described herein. Applications that can include the apparatus and systems of various embodiments broadly include a variety of electronic and computer systems. Some embodiments may implement functions in two or more specific interconnected hardware modules or devices with related control and data signals communicated between and through the modules, or as portions of an application-specific integrated circuit. Thus, the exemplary system is applicable to software, firmware, and hardware implementations.

Figure 8:
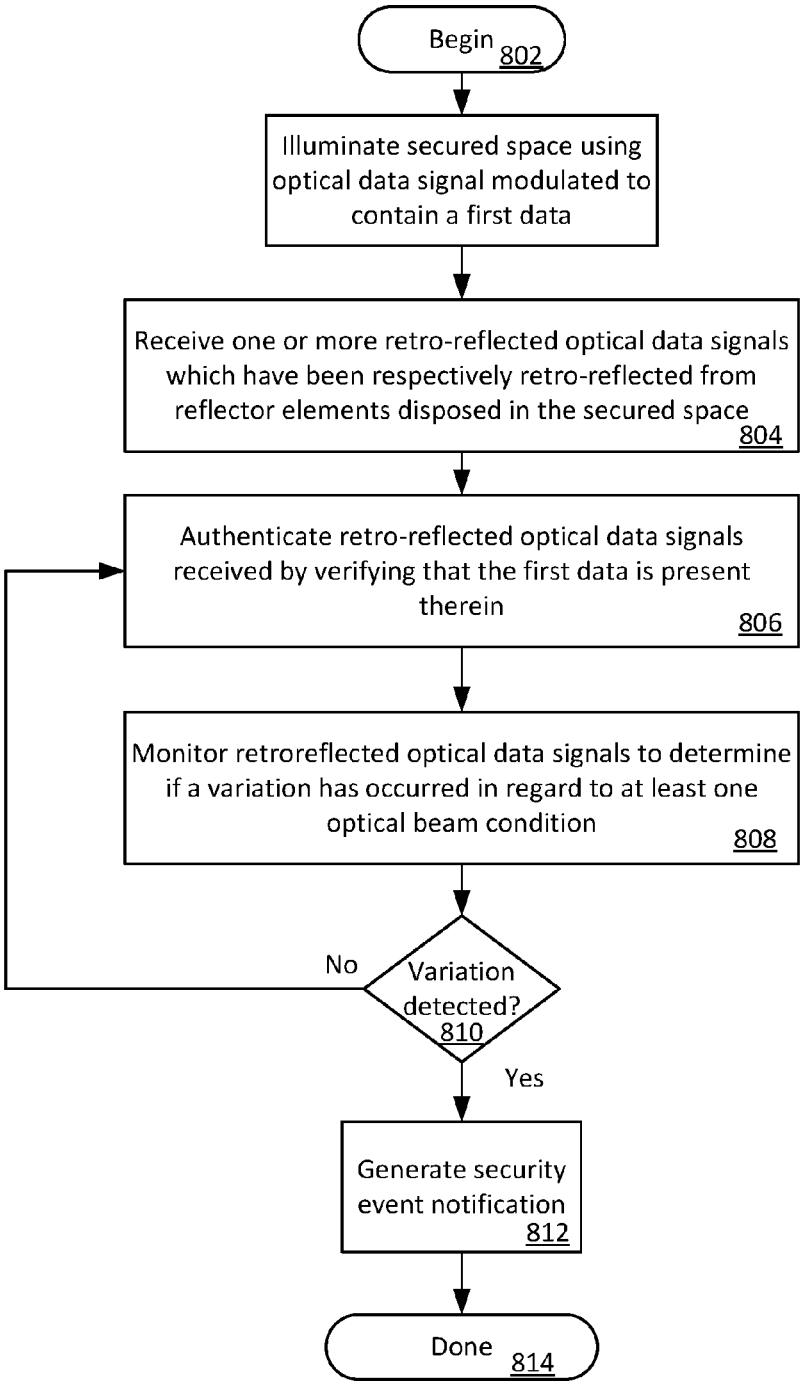
FIG. 8 is a flowchart that is useful for understanding an embodiment process.

Referring now to FIG. 8 there is provided a flowchart that is useful for understanding an embodiment process. The process begins at 800 and continues at 802 where an optical transceiver is used to illuminate a secured space using an optical data signal modulated to contain a first data. As used herein, illuminate should be understood to mean transmitting or broadcasting the optical signal into a secured space and may or may not involve illuminating the room to in the conventional sense to facilitate visibility for users. The process continues at 804 where one or more retroreflected optical data signals are received at the optical transceiver. As noted above, the retroreflected optical data signals are optical signals originating from the optical transceiver, but have been retroreflected from a plurality of reflector elements disposed in the secured space. At 806, authentication of the plurality of retroreflected optical data signals is performed. This step is to verify that the received optical data signals are in fact retroreflected optical data signals that originated from the optical transceiver. The authentication step can involve verify that a first data sequence contained in the transmitted optical data signal is identical to a second data sequence contained in the received optical data signal.

The process continues at 808 by monitoring the retroreflected optical data signals to determine if a variation has occurred in regard to at least one optical beam condition. Such optical beam condition can involve an interruption of a retroreflected optical beam (i.e., the beam is no longer detected). However, the variation can also comprise a substantial variation in the detected intensity or optical signal strength. As an example, such a variation may occur when a door is partially opened and a retroreflector position has changed to an unfavorable (or improved) orientation for purposes of retroreflection. The variation can also involve a displacement of the optical beam as described herein with respect to FIGS. 5A and 5B.

Based on such monitoring, a decision is made at 810 as to whether a variation has been detected. If not (806: No), then the process returns to 806 and 810 for continued authentication and monitoring. But if a variation is detected (806: Yes) a security event notification is selectively generated to an enterprise security management controller.

One advantage of a security sensing system described herein derives from the fact that the optical data signal transmitted by the optical transceiver is modulated to contain a particular data sequence. The presence of the data sequence allows the optical transceiver to authenticate a received optical signal to determine whether it is a retroreflected optical data signal. This authentication process can involve comparing a data sequence in the received signal optical signal to the transmitted optical signal to determining whether the same data sequence is present in each. But in some scenarios, a person attempting to thwart the security sensing system may try to do so by using an optical jammer. For example, such persons could attempt to overpower the optical receiver with a higher powered beam of light. In such a scenario, the person seeking to jam the sensor without modulating the higher powered beam of light. Alternatively, they might use an optical receiver to detect the transmitted optical beam and then independently generate a new optical beam which actually contains the particular data sequence contained in the optical beam transmitted by the security system.

To overcome this potential issue, the processing components of the optical transceiver described herein can apply further authentication criteria. For example, the processing components can compare a timing of a modulated data stream in a received optical signal to a timing of the modulated data signal in the transmitted modulated optical data signal. A timing of a modulated data sequence in an authentic retroreflected optical data signal should be delayed only a very small duration of time relative to the modulated data sequence in a transmitted optical data signal. If the delay exceeds a predetermined threshold, then the received optical signal can be rejected as non-authentic.

Further, the optical transceiver in response to detecting a jamming signal or a non-authentic optical data signal, can perform certain countermeasure actions. For example, if a video camera is used as the optical receiver, then the wavelength of the received optical signal (jamming signal and/or non-authentic optical data signal) can be determined or approximated. In such scenarios, the processor can cause the optical transceiver to selectively transition to another wavelength so that the transmitted modulated optical data signal illuminates the secured area using optical radiation having an alternate optical wavelength. The alternate optical wavelength can be in a portion of the visible, infrared or near ultraviolet spectrum which is different as compared to that previously in use by the system. For example, if the optical transceiver system were to detect a significantly high level of light in the 530 nm (green) or 630 nm (red) wavelengths, the transceiver can dynamically shift its dominating transmitting and receiving frequencies to a less sensitive wavelength such as 430 nm (blue), thus preventing the monitoring system from being defeated. According to a further embodiment, the optical transceiver can be caused to periodically hop at a rapid rate among a plurality of different optical wavelengths to thwart attempts at defeating the system. If a received optical data signal has the wrong wavelength at a particular moment in time, then it can be determined to be a non-authentic retroreflected optical data signal on that basis alone.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

We claim:

1. A method for performing security sensing, comprising:

using an optical data transceiver to illuminate a secured space with an optical data signal which has been modulated to contain a first data sequence which includes at least a portion of a management frame defined for a predetermined wireless communication protocol;

concurrently receiving at the optical data transceiver a plurality of retroreflected optical data signals which have been respectively retroreflected from a plurality of reflector elements disposed in the secured space in response to the optical data signal;

authenticating one or more of the plurality of retroreflected optical data signals by determining whether the first data sequence is present therein; and selectively generating a security event notification to an enterprise security management controller if a variation occurs in regard to at least one optical beam condition associated with one or more of the plurality of retroreflected optical data signals, the variation selected from the group consisting of a disruption of the optical beam and a displacement of the optical beam.

2. The method according to claim 1, further comprising using the optical data transceiver to facilitate wireless network access to a computer data network.

3. The method according to claim 2, further comprising using the computer data network to communicate the security event notification to the enterprise security management controller.

4. The method according to claim 1, further comprising selecting the management frame to be a beacon frame.

5. The method according to claim 1, wherein the plurality of retroreflected optical data signals are received at the optical transceiver using a video camera.

6. The method according to claim 5, wherein the displacement of the optical beam is detected by comparing a first video image frame captured at a first time to a second video image frame captured at a second time subsequent to the first time.

7. The method according to claim 6, wherein the comparing comprises comparing a first pixel location within the first video image frame where the at least one optical beam is detected at the first time to a second pixel location within the second video frame where the at least one optical beam is detected at the second time.

8. The method according to claim 1, further comprising disposing the plurality of reflector elements on at least one of a door and a window panel.

9. The method according to claim 1, further comprising selecting the optical radiation associated with the optical data signal to have a wavelength in at least one of the visible, infrared or near ultraviolet range.

10. The method according to claim 1, further comprising authenticating one or more of the plurality of retroreflected optical data signals by comparing a first optical wavelength the retroreflected optical data signal to a second wavelength of an optical data signal transmitted into the secured space.

11. A method for performing security sensing, comprising:

using an optical data transceiver to illuminate a secured space with an optical data signal which has been modulated to contain a first data sequence;

concurrently receiving at the optical data transceiver a plurality of retroreflected optical data signals which have been respectively retroreflected from a plurality of reflector elements disposed in the secured space in response to the optical data signal;

authenticating one or more of the plurality of retroreflected optical data signals by determining whether the first data sequence is present therein;

selectively generating a security event notification to an enterprise security management controller if a variation occurs in regard to at least one optical beam condition associated with one or more of the plurality of retroreflected optical data signals, the variation selected from the group consisting of a disruption of the optical beam and a displacement of the optical beam; and selectively changing a wavelength of an optical radiation used for said optical data signal used to illuminate the secured space.

12. The method according to claim 11, wherein the wavelength is changed in response to determining the presence of a jamming optical signal.

13. An optical data transceiver, comprising:

an optical transmitter unit configured to illuminate at least a portion of a secured space with an optical data signal which has been modulated to contain a first data sequence;

an optical receiver unit configured to concurrently receive a plurality of retroreflected optical data signals which have been respectively retroreflected from a plurality of reflector elements disposed in the secured space in response to the optical data signal;

a network interface device to facilitate digital data communications in accordance with a data network communication protocol as between a digital data network and at least one of the optical data transmitter and the optical data receiver; and at least one processing element which is configured to:

receive a plurality of digital data streams extracted respectively from the plurality of retroreflected optical data signals;

authenticate one or more of the plurality of retroreflected optical data signals by determining whether the first data sequence is present therein;

detect a variation in regard to at least one optical beam condition associated with one or more of the plurality of retroreflected optical data signals, the variation selected from the group consisting of a disruption of the optical beam and a displacement of the optical beam; and selectively generate a security event notification message if the variation is detected;

wherein the at least one processing element is configured to perform processing operations involving optical signals received by the optical receiver unit and optical signals transmitted by the optical transmitter unit to facilitate wireless network access to the computer data network for a plurality of client devices.

14. The optical data transceiver according to claim 13, wherein the at least one processing element is configured to cause the security event notification to be communicated to the enterprise security management controller using the computer data network.

15. The optical data transceiver according to claim 13, wherein the first data sequence comprises at least a portion of a management frame defined for a predetermined wireless communication protocol.

16. The optical data transceiver according to claim 15, wherein the management frame is a beacon frame.

17. The optical data transceiver according to claim 13, wherein optical receiver unit is a video camera, and the at least one processing element is configured to extract the plurality of retro-reflected optical data signals from the video information capture by the video camera.

18. The optical data transceiver according to claim 17, wherein the at least one processing element is configured to detect displacement of the optical beam by comparing a first video image frame captured at a first time to a second video image frame captured at a second time subsequent to the first time.

19. The optical data transceiver according to claim 18, wherein the at least one processing element is configured to compare a first pixel location within the first video image frame where the at least one optical beam is detected at the first time, to a second pixel location within the second video frame where the at least one optical beam is detected at the second time.

20. The optical data transceiver according to claim 13, wherein the optical data signal generated by the optical transmitter unit is comprised of optical radiation having a wavelength in at least one of the visible, infrared or near ultraviolet range.

21. An optical security sensing apparatus, comprising:

a plurality of retroreflectors disposed in a secured area; and an optical transceiver including an optical transmitter unit configured to illuminate at least a portion of the secured space with an optical data signal which has been modulated to contain a first data sequence, an optical receiver unit configured to concurrently receive a plurality of retroreflected optical data signals which have been respectively retroreflected from the plurality of reflector elements in response to the optical data signal, and at least one processing element which is configured to receive a plurality of digital data streams extracted respectively from the plurality of retroreflected optical data signals, determine whether the first data sequence is present in one or more of the plurality of retro-reflected optical data signals, detect a variation in regard to at least one optical beam condition associated with one or more of the plurality of retroreflected optical data signals, the variation selected from the group consisting of an disruption of the optical beam and a displacement of the optical beam, and selectively generate a security event notification message if the variation is detected;

wherein the optical transceiver is configured to function as a wireless network access point, and the optical data signal comprises at least a portion of a management frame defined for a predetermined wireless communication protocol.

* * * * *